US008328001B2

(12) United States Patent
Benz

(10) Patent No.: US 8,328,001 B2
(45) Date of Patent: Dec. 11, 2012

(54) METHOD AND DEVICE FOR OPENING PRINTED PRODUCTS

(75) Inventor: Marc-Andreas Benz, Gruet (CH)

(73) Assignee: Ferag AG, Hinwil (CH)

( * ) Notice: Subject to any disclaimer, the term of this patent is extended or adjusted under 35 U.S.C. 154(b) by 352 days.

(21) Appl. No.: 12/832,414

(22) Filed: Jul. 8, 2010

(65) Prior Publication Data

US 2011/0005893 A1 Jan. 13, 2011

(30) Foreign Application Priority Data

Jul. 13, 2009 (CH) ..... 1088/09

(51) Int. Cl.
*B65H 5/30* (2006.01)

(52) U.S. Cl. ..... 198/644; 270/52.27

(58) Field of Classification Search ..... 198/644.1; 270/52.23, 52.24, 52.25, 52.27, 52.28
See application file for complete search history.

(56) References Cited

U.S. PATENT DOCUMENTS

| | | | | |
|---|---|---|---|---|
| 5,248,135 | A * | 9/1993 | Leu | 270/52.27 |
| 5,292,111 | A * | 3/1994 | Hansch | 270/52.27 |
| 5,354,043 | A * | 10/1994 | Reist | 270/52.27 |
| 5,474,285 | A | 12/1995 | Stauber | |
| 5,794,926 | A | 8/1998 | Hansch | |
| 7,318,587 | B2 * | 1/2008 | Hansch | 271/204 |
| 2007/0164501 | A1 | 7/2007 | Brommer | |

FOREIGN PATENT DOCUMENTS

| | | |
|---|---|---|
| EP | 0 647 582 | 4/1995 |
| EP | 0 721 903 | 7/1996 |
| EP | 1 808 390 | 7/2007 |

* cited by examiner

*Primary Examiner* — Mark A Deuble
(74) *Attorney, Agent, or Firm* — Rankin, Hill & Clark LLP

(57) ABSTRACT

In a method and a device for opening printed products (26), folded printed products (20) are held on a back (28) and transported. Thereby, they are aligned at an edge region (44) lying opposite the back (28), for example by way of co-running lugs (98'). Subsequently, the edge region (44) is encompassed by a holding element (50) and held in a preferably loose manner. Preferably, the uppermost sheet of the printed product (26) is gripped with a revolving opening element (72) engaging on the printed product (26) behind the edge region (44), and pulled out of the holding element (50), while the remaining sheet or the remaining sheets of the printed product (26) remain in the holding element (50). After moving a holding-open element (102) into the printed product (26) opened in such a manner, the holding element (50) moves away to the bottom and thus the edge region (44) of the printed product (26) slips out of the holding element (50).

15 Claims, 4 Drawing Sheets

METHOD AND DEVICE FOR OPENING PRINTED PRODUCTS

BACKGROUND OF THE INVENTION

1. Field of the Invention

The invention relates to a method and to a device for opening printed products, according to the preamble of the respective independent patent claims.

2. Description of Related Art

A device of the known type is known for example from EP 0 647 582 A1. Printed products to be opened are held at their backs by way of transport clips, are transported in an essentially vertical hanging position, and are pushed in the conveying direction in a supported manner, with their end region which is bent to the front in the conveying direction and which lies opposite the back. This gives the open edge of the printed product, which lies opposite the back, a defined position, stabilised by way of the bending of the printed products and holds these at a secure distance to one another, so that a suction head as an opening element may be moved from above the support element supporting the printed products, into between the printed products. The opening element, from above the support element, engages between the printed products and bears on these, whilst a further suction head bears from below onto the printed product. The products parts are firmly held on both sides during the complete opening procedure by way of this. The device is designed for opening folded individual sheets or 2-fold products, which are folded a first time and a second time at right angles to this. The 2-fold product may not be cut, in order to be able to be reliably opened.

EP 1 808 390 shows a device for depositing individual printed products which are fed in a consecutive manner, into an imbricate flow. Thereby, the printed products are gripped by way of a stream assembly with revolving, openable and closable grippers. The grippers are arranged in a rotating drum and are actuated by a stationary control cam. The grippers firmly hold the printed products, in order to pull them and deposit then onto an imbricate flow. Thus, an opening of the products is not possible as long as they are held in the gripper.

BRIEF DESCRIPTION OF THE INVENTION

It is therefore the object of the invention, to provide a method and a device for opening printed products of the initially mentioned type, which may be applied to a greater variety of printed products, in particular to multi-sided, cut products.

This object is achieved by a method and a device for opening printed products with the features of the respective independent claims. The printed products to be opened are multi-sided, and are formed, for example, by way of folding, binding, gluing, stitching etc., and as a rule are also cut, thus are cut at three edges of the printed product.

In the method and the device for opening printed products, thus printed products are held and transported on a back. Thereby, they are aligned at an edge region which lies opposite the back, preferably by way of co-running lugs. Subsequently, the edge region is encompassed by a holding element and held in a loose manner. Preferably, the uppermost sheet of the printed product is gripped with a revolving opening element engaging behind the edge region on the printed product, and is pulled out of the holding element, whilst the remaining sheet or the remaining sheets of the printed product remain in the holding element. After the moving of a holding-open element into the printed product opened in such a manner, the holding element moves away to the bottom and thus the edge region of the printed product slips out of the holding element.

In detail, thus, the method has the following steps:

transporting printed products with a conveyor device with transport clips which are driven in the conveying direction and which are arranged at a distance behind one another, wherein the transport clips hold the printed products, preferably in a hanging manner, at their back, running transversely to the conveying direction and connecting the product parts to one another;

supporting the printed products at their edge region lying opposite the back and leading in the conveying direction, with a support element which is arranged below the conveyor device and which forms a conveyor plane acting essentially in the conveying direction moving in between consecutive printed products above the support element with an opening element which revolves along a closed movement path, applying the opening element, running with the rear of these consecutive printed products from above onto its upper-lying product part, and firmly holding it;

wherein the further steps are carried out;

encompassing the edge region of the printed product and supporting the printed product by way of a holding element which is moved along a closed revolving path and which runs with the respective printed product.

wherein the opening element engages on the printed product in a holding region lying behind the edge region seen in the conveying direction, firmly holds the second product part and pulls it out of the holding element.

The transport clips can, in general, be elements for pegging, resp. gripping the printed products. They particularly can be grippers.

Thus as a second product part, preferably only the first sheet is pulled out of the printed product, or however a greater number of sheets. The number of sheets which is pulled out, if the opening element is a suction head, is a function of the vacuum, with which the suction head is operated, and the thickness of the sheets as well as the porosity or permeability of the paper of the printed product to air. The greater is the vacuum, the more sheets are suctioned and held though the first sheet with a product which is permeable to air. In a preferred embodiment of the invention, thus the vacuum with which the opening element is fed in each case on opening, may be set. With this—with a limited accuracy—the number of the pulled-out pages and thus location of the opening may be controlled.

The invention is, thus, suitable in particular for opening individual sheets which are folded once ("four-sider"), but also multi-sided products which have no further fold. A further fold would run essentially perpendicular to the first fold and on opening, if the further fold faces the opening assembly, would lift a complete product half. A multi-sided product may, for example, be a product which is folded several times and then cut.

It is not necessary for the printed product to have a gripper fold, in order to be able to be opened. This means that the first product part and the second product part may be equally long, seen from the back.

On pulling the second product part out of the holding element, the second product part lies in the holding element preferably in a loose manner, thus without being clamped in. A simple design of the holding elements without further actuation elements for controlling the holding elements, for example for the synchronous clamping and release of the printed products, becomes possible by way of this. In another embodiment of the invention, the holding elements may be actuated, so that the printed products may be held with a slight clamping force, thus are held with a positive fit and with a slight frictional fit. The actuation may be effected electrically, pneumatically, mechanically, etc.

In a preferred variant of the invention, the following further steps take place:

before encompassing the edge region with a holding element, holding-back and aligning the printed products at their edge of the edge region, which lies opposite the back, by way of aligning lugs which project from a revolvingly driven lug belt and which in the region of the upper section of the lug belt, move with a speed which is smaller or equal to a conveyor speed of the conveyor device.

By way of this, it is possible to bring the front edge of the edge region firstly along a longer path, into a controlled position and to align it, before the transfer to the holding elements takes place. The lugs, thereby, form no pockets, but are in each case roughly perpendicular to the edge region (preferably a little inclined towards the edge region), whereas the holding elements with their edge regions in each case run roughly parallel to the edge region.

In a preferred variant of the invention, the following further steps take place:

moving the holding element in each case between two of the printed products, into a path which follows the revolving path of the lug belt, but lies next to this in a laterally displaced manner. This path corresponds to a path section of the lug belt and a path section of the revolving path of the holding element, in which these move in "parallel" paths.

moving the holding element, following this path and with a speed, which is smaller than the speed of the aligning lugs; and by way of this moving the edge region into the holding element.

By way of this, a transfer of the printed products with their edge regions, from the lugs onto the holding elements, is realised.

Further preferred embodiments are to be deduced from the dependent patent claims. Thereby, features of the method claims with regard to context may be combined with the device claims and vice versa.

BRIEF DESCRIPTION OF THE DRAWINGS

Hereinafter, the subject-matter of the invention is explained in more detail by way of preferred embodiment examples, which are represented in the accompanying drawings. In each case there are schematically shown in.

The reference numerals which are used in the drawings, and their significance are listed in conclusive manner in the list of reference numerals. Basically, in the figures, the same parts are provided with the same reference numerals.

DETAILED DESCRIPTION OF THE INVENTION

Figure 1:
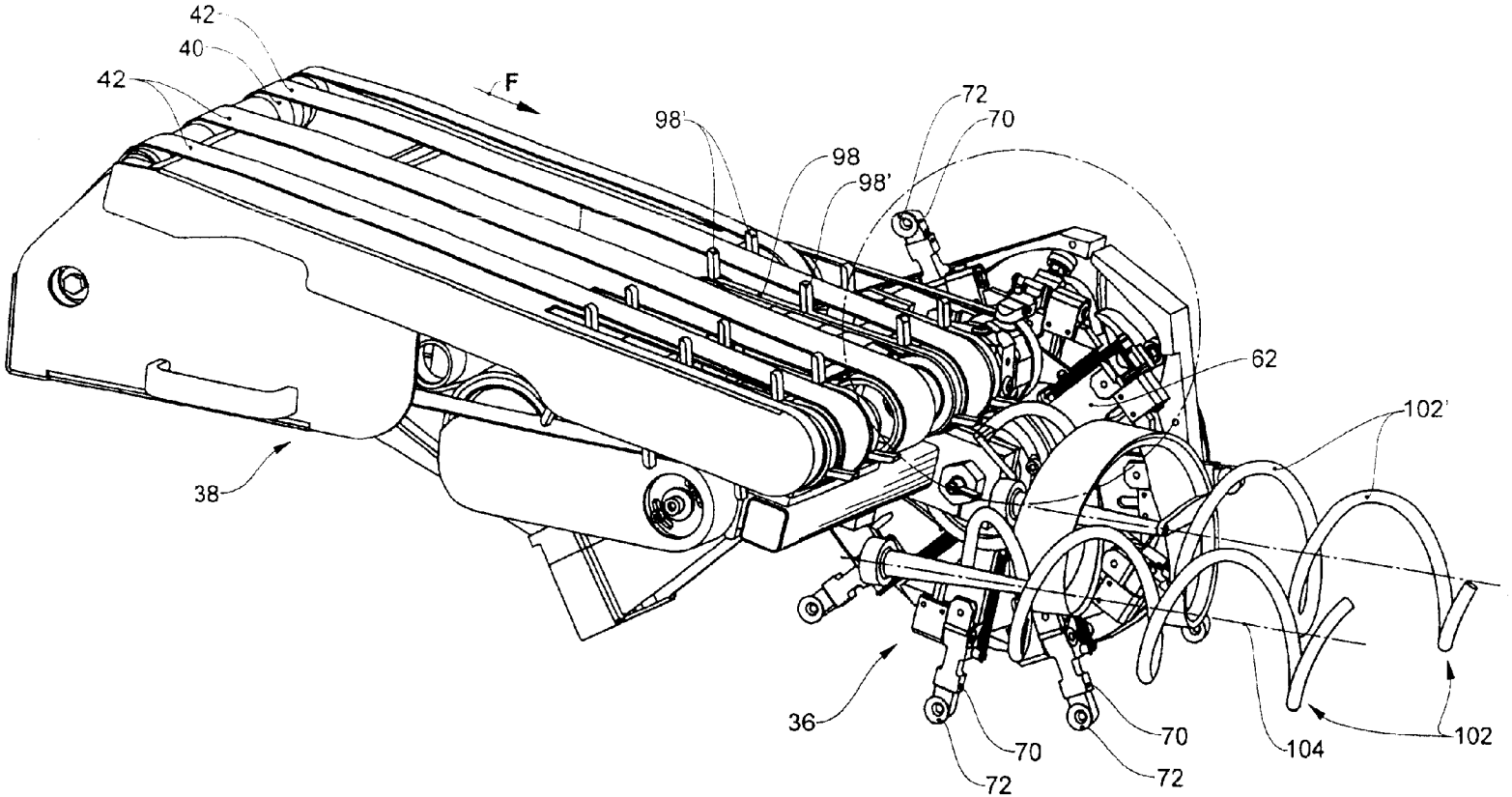
FIG. 1 perspectively, a device for opening printed products.
Figure 2:
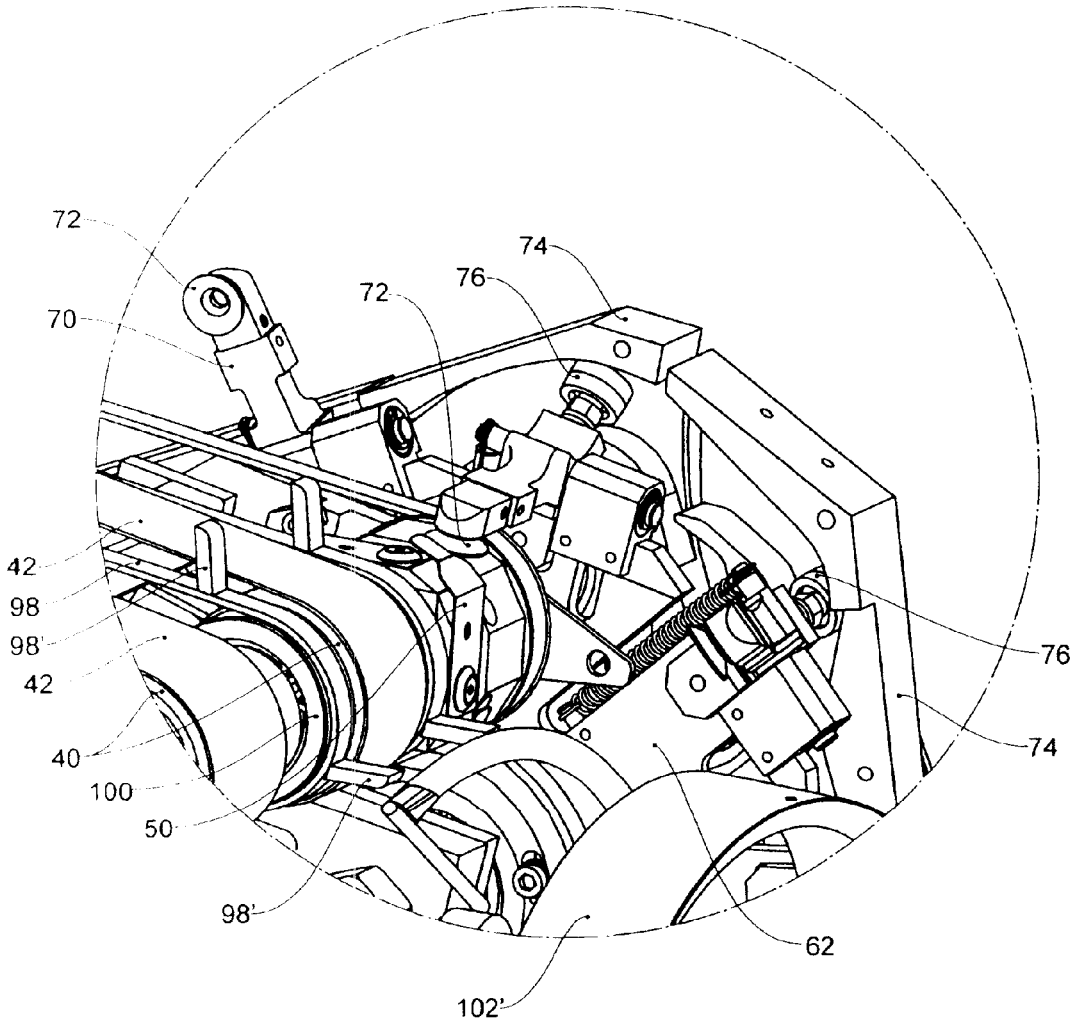
FIG. 2 enlarged, a detail of FIG. 1.
Figure 3:
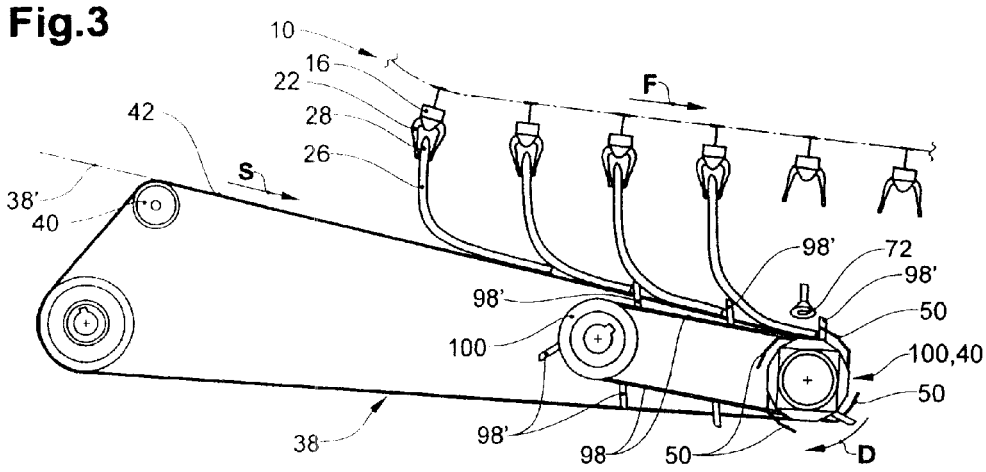
FIGS. 3-7 a procedure on opening a printed product by way of the device of FIG. 1.

FIG. 1 perspectively shows a device for opening printed products, with an opening assembly 36, which according to the schematic lateral view of FIG. 3, is to be arranged below a conveyor device 10. FIG. 2 in an enlarged manner shows a detail of the opening assembly 36, in the region in which the opening of the printed products takes place.

A support element 38 which is likewise arranged below the conveyor device 10, is arranged directly upstream of the opening assembly 36. A detailed description of an opening assembly 36 with opening elements 72 designed as a suction head, as well as of a support element 38, is to be found in the already mentioned EP 0 647 582 A1, which is herewith adopted in its entirety by way of reference. Here however, holding elements 50 are present, instead of the suction heads in the deflection roller 46, which are described there.

The support element 38 comprises endless support belts 42 which are led around deflection rollers 40 and which are driven in the revolving direction S with a speed vs, which is larger, preferably twice as large as a conveyor speed vf of the conveyor device 10. Endless lug belts 98 which are led around the deflection wheels 100, are arranged between (possibly next to) the support belts 42. The lugs 98' of the lug belts 98, from below, penetrate through the conveyor plane 38' and project with their free end beyond this. The lugs 98' are inclined to the rear (with respect to the conveying direction) and thus with the lug belt 98 form an angle of less than 90°. The lug belts 98 are driven with a speed vn, which, for example, is about 80% of the speed vf of the transport clips 16. Accordingly, the distance between the lugs 98' is roughly 80% as large as the distance of the transport clips 16. The defection wheels 100 rotate preferably about the same axis as the deflection rollers 40 of the support belts 42.

The opening assembly 36 at one side of the conveyor path or the deflection rollers 40 and the deflection rollers 100 for deflecting the support belts 42 and the lug belts 98, comprises a carrier element 62 which is designed in a disk-like manner and which is rotatable about an axis running at right angles to the conveying direction F and running in the horizontal direction. Carrier arms 70 are mounted in a pivotable manner on the carrier element 62 radially to the outside, and distributed in the peripheral direction. In each case, these at one end carry an opening element 72 designed as a suction head and at the other end a cam roller 76 which cooperates with cam guides 74. A likewise rotating support body which supports the printed products 26 with a pressing of the opening element 72, is arranged about the common axis of the deflection rollers 40 and deflection rollers 100.

Holding elements 50 are provided at the end of the support element 38, for opening the printed products 36. A holding element 50, seen in the movement direction, is open to the rear and may, thus, receive the edge region 44 of a printed product 26. The function of a holding element 50 is to receive and hold back the edge region 44, whilst a product part is pulled out of the holding element 50, and the rest of the printed product 26 remains with its edge region 44 in the holding element 50.

The holding elements 50 are preferably arranged in a revolving manner in a circular path, i.e. on deflection rollers 46, which are mounted on an axis or shaft arranged horizontally and at right angles to the conveying direction F, as the deflection rollers 40 for the support belts 42, at the end of the support element 38. A deflection roller 46 comprises, for example, four holding elements 50 which are uniformly distributed in the peripheral direction and whose revolving path is essentially tangent to the conveyor plane 38' which is defined by the upper section of the support belts 42. The rotational direction D of the deflection rollers 46, deflection rollers 40 and the deflection wheels 100, which revolve with different speeds, is indicated in the figures with an arrow.

A holding element 50 is manufactured, for example, of bent spring steel, preferably as one piece. The bending of the holding element 50 is preferably approximately concentric to the rotation axis of the deflection roller 46. The holding element is preferably elastic per se, but is firmly fastened on the deflection roller 46. The holding elements 50 thus form a pocket-like holder for the printed products 26, which is open to the rear.

The deflection rollers 46 are driven independently of the lug belts 98 and support belts 42. Their speed is controlled in a mechanical and/or electronic manner, such that the speed of the holding elements 50 is lower than that of the lugs 98'. Thus holding elements 50 are overtaken by the lugs 98' on moving about the axis of the deflection roller.

Further, the opening assembly 36 comprises a holding-open element 102 which is shaped in a spiral-like manner and which, in a rotating manner about its axis of the holding-open element 102 which runs parallel to the conveying direction F, is driven in a manner such that the section 102' which in each case lies at the top, moves together with the transport clips 16 in the conveying direction F. These sections 102' in each case engage between the product parts 30, 32 which are lifted from one another on opening, in order to hold these open with the further transport.

The manner of functioning of the described devices is now described in more detail by way of the FIGS. 3 to 7. In these figures, the clip jaws 22 of several transport clips 16 are indicated according to a predefined cycled distance. The following embodiments relate to the procedures at one side of the path of the printed product 26, wherein mirror-symmetrical components and procedures are present at the opposite side.

Figure 5:
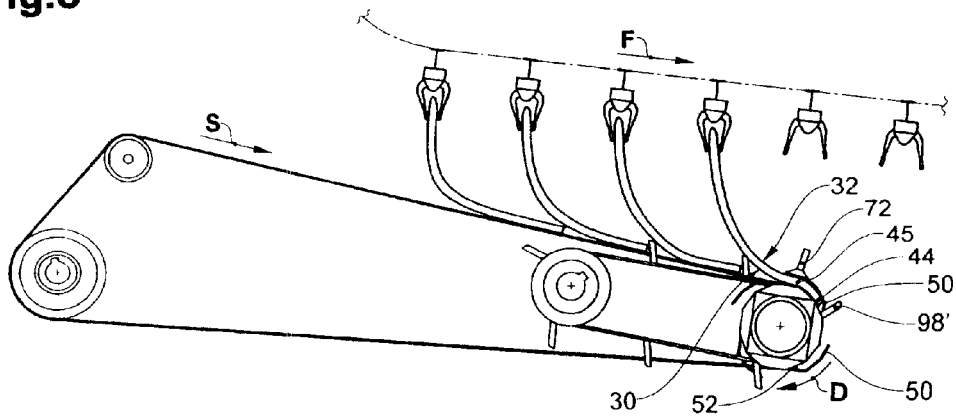

The printed products 26 lie on the support belts 42 with their edge region 44 which is bent to the front. The support belts 42 move with speed vs which is larger than that of the transport clips 16. As a result of frictional catching between the support belts 42 and the printed products 26, the printed products 26 are therefore pushed to the front in the conveying direction F and with their open edge or front edge 34, also called bloom, come to bear on lugs 98' for alignment. Since these revolve with a lower speed vn than the transport clips 16, the printed products 26 are bent in a U-shaped or S-shaped manner, which gives them stability. Then from the side, a carrier arm 70 is pivoted between in each case two printed products 26, by which means the opening element 72 concerned lowers with a helix-like movement onto the upper-lying second product part 32, before the edge region 44 of the printed products 26 which trails the carrier arm 70 seen in the conveying direction F (FIG. 5).

Figure 4:
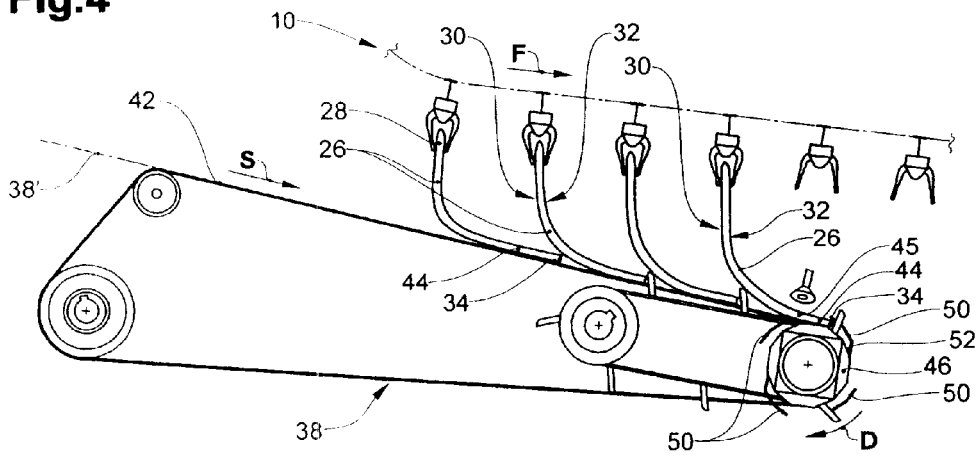

Simultaneously, moved in the same direction as the lug belt, a hook-like holding element 50 moves into the movement path of the edge region 44. Since the holding element 50 is open to the rear, it may receive the edge region 44 (FIGS. 3 to 5). The lugs 98' for this revolve with a somewhat larger speed (vn) than the holding elements 50 (vu), by which means the lugs 98' move away from the front edge 34 of the printed products 26, as soon as these are held in a holding element 50. By way of this, the edge region 44 is transferred from the lugs 98' to the holding elements 50 and it is ensured that the subsequent opening of the printed products 26 is not inhibited by the lugs 98'.

The holding elements 50 obtain the alignment of the printed products 26 in the conveying direction, which is created by the lugs 98' and, in a direction perpendicular to the movement direction of the holding elements 50, hold the individual pages in the edge region 44 of the printed products 26 together, in a preferably loose manner, without thereby clamping the sides. Preferably, no actuation devices or control devices are necessary for moving the holding elements 50. They simply rotate together with the deflection roller 46. In another preferred embodiment of the invention, the holding elements 50 may be actuated for the cycled, slight clamping and subsequent release of the printed products 26.

The transfer from the lugs 98' to the holding elements 50 takes place during a movement of the front edge 34 along a path section of the lug belt 98 and a path section of the revolving path of the holding element 50, in which these move in "parallel" paths. These path sections correspond, for example, to a tenth to an eighth or a quarter of the periphery of the deflection roller. At the beginning of these path sections (FIG. 3), the front edge 34 is located in the abutment on the lugs 98', at its end (FIG. 5) the edge region 44 is located with the front edge 34 in the abutment 52 on the holding elements 50.

Figure 6:
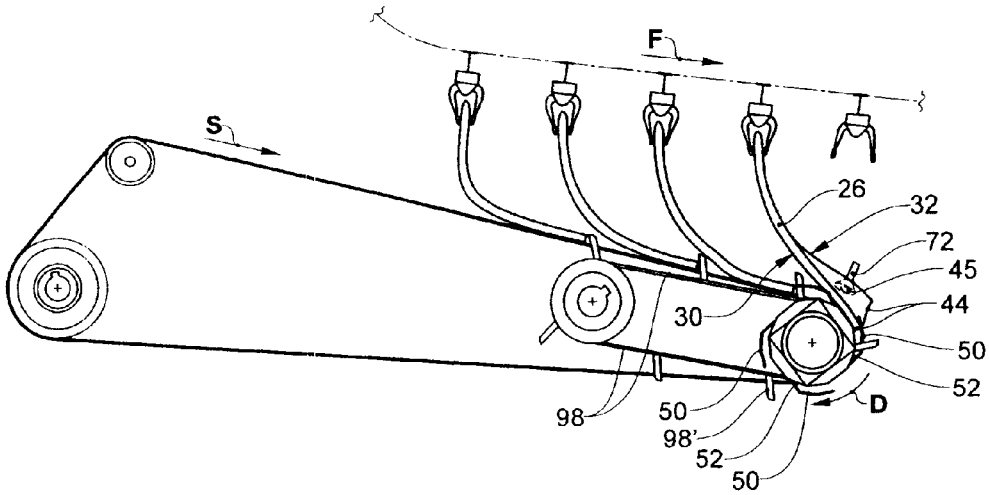

The synchronisation between the carrier element 62 and the deflection roller 46 is selected in a manner such that in the region of the deflection roller 46, in each case a holding element 50 encompasses the edge region 44, and an opening element 72 engages on the printed products 26. The opening element 72 seen in the conveying direction, thereby comes to lie in each case behind the holding element 50 and preferably offset in the axis direction of the deflection roller 46, in a holding region 45 of the second product part 32 (FIGS. 2 and 5), and thus may pull the upper-lying second product part 32 out of the holding element 50 (FIG. 6). On pulling-out, the second product part 32 bends in the edge region 44, which is not a problem since the second product part 32 as a rule is only a single side. All remaining sides form the first product part 30 and remain with their edge region 44 in the holding element 50.

Figure 7:
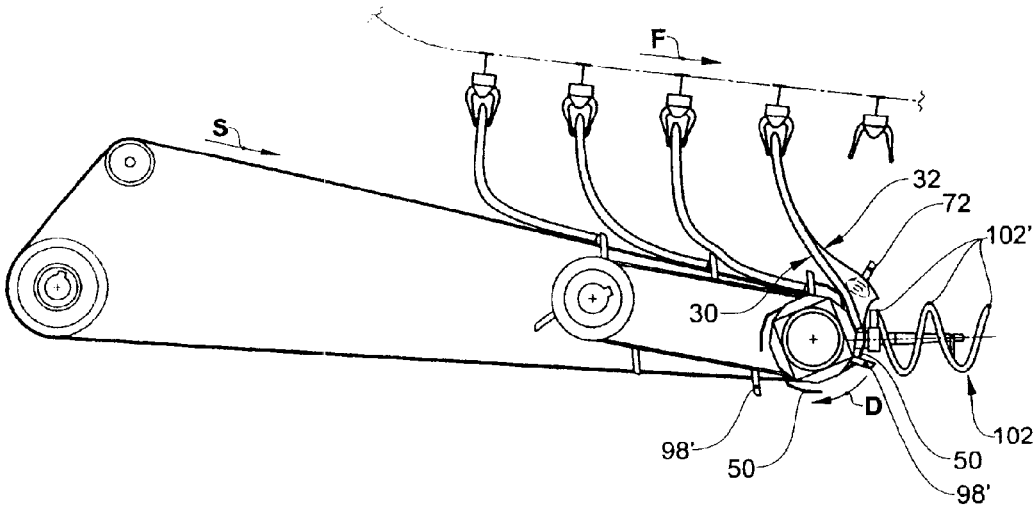

The opening element 72 is connected to a vacuum source, in order to firmly hold the (upper-lying) second product part 32. By way of rotating the deflection roller 46 the edge region 44 now with the leading edge of the first product part 30, lying in the holding element 50, is led downwards about the deflection roller 46 and moreover, seen in the conveying direction, is delayed with respect to the back 28 (FIGS. 6 and 7). The upper-lying second product part 32, firmly held by the opening element 72, is moved further essentially in the conveying direction F along the movement path of the opening element 72, wherein the second product part 32 is pulled out of the holding element 50. By way of this, the printed product 26 is opened. The S-shaped bending in the printed product 26 is essentially lifted (FIG. 7) as a result of the guiding of the first product part 30 about the deflection roller 46 to the bottom and as a result of the movement of the opening element 72 concerned.

From below, the holding-open element 102 penetrates between the product parts 30, 32 which have been lifted from one another (FIG. 7), whereupon the opening element 72 is ventilated and lets go of the second product part 32. Simultaneously, the holding element 50 rotates further downwards and releases the first product part 30, by way of the edge region 44 which hangs down slipping out of the holding element 50. On further transport, the printed products 26 are held open by way of a section 102' of the holding-open element 102, which engages in each case between the product parts 30, 32. After ventilating the opening element 72, the carrier arm 70 concerned is pivoted back with the opening element 72.

It is to be mentioned that, of course, a carrier arm 70 is pivoted in always between two consecutive printed products 26, but in the FIGS. 3 to 7 however in each case only one opening element 72 is drawn for the sake of a better overview.

Of course, the movement of support belts 42, lug belts 98, opening elements 72, deflection rollers 46 and holding-open elements 102 to the conveyor device 10 is synchronised and may be set it its mutual phase position. Further, the support element 38 and the opening assembly 36 are height-adjustable in the vertical direction, in order to ensure an adaptation to differently formatted printed products 26.

LIST OF REFERENCE NUMERALS

10 conveyor device
16 transport clip
22 clip jaw
26 printed product
28 back
30 first product part
32 second product part
34 front edge
36 opening assembly
38 support element
38' conveyor plane
40 deflection roller
42 support belts
44 edge region
45 holding region
46 deflection roller
50 holding element
52 abutment on the holding element
62 carrier element
70 carrier arm
72 opening element
74 guide
76 cam roller
98 lug belt
98' lugs, aligning lugs
100 deflection wheels
102 holding-open element
102' section of the holding-open element
104 axis of the holding-open element
F conveying direction
S revolving direction of the support element
D rotation direction

The invention claimed is:

1. A method for opening printed products, comprising the steps:

transporting printed products with a conveyor device with transport clips which are driven in the conveying direction (F) and which are arranged at a distance behind one another, wherein the transport clips hold the printed products at their back running transversely to the conveying direction (F) and connecting first and second product parts to one another;

supporting the printed products at their edge region which lies opposite the back and which leads in the conveying direction (F), with a support element which is arranged below the conveyor device and which forms a conveyor plane acting essentially in the conveying direction (F);

moving in between consecutive printed products, above the support element, with an opening element which revolves along a closed movement path, applying the opening element, running with the rear of these consecutive printed products, from above onto its upper-lying product part, and firmly holding it;

wherein the method comprises the further steps:

encompassing the edge region of the printed product and supporting the printed product by way of a holding element which is moved along a closed revolving path and which runs with the respective printed product;

wherein the opening element engages on the printed product in a holding region lying behind the edge region seen in the conveying direction, and firmly holds the second product part and pulls it out of the holding element.

2. A method according to claim 1, with the further step:

moving the product parts away from one another in the edge region, in opening sections of the movement path of the opening element and of the revolving path of the holding element, by way of the further pulling of the second product part in the conveying direction (F) by way of the opening element and holding back the first product part counter to the conveying direction (F) by way of the holding element.

3. A method according to claim 1, wherein the second product part has exactly one sheet.

4. A method according to claim 1, wherein the second product part has two or more sheets.

5. A method according to claim 4, wherein the number of sheets of the second product part is at least approximately controllable by way of setting a settable vacuum of a suction head acting as an opening element.

6. A method according to claim 1, wherein the back is formed by a fold, and the printed product apart from this fold has no further fold.

7. A method according to claim 1, wherein the printed product has no gripper fold.

8. A method according to claim 1, wherein on withdrawing the second printed product out of the holding element, the second product part lies in the holding element in a loose manner.

9. A method according to claim 1, with the further step:

before encompassing the edge region with the holding element, holding back and aligning the printed products at their edge of the edge region, said edge lying opposite the back, by way of aligning lugs which project from a revolvingly driven lug belt and which in the region of the upper section of the lug belt, move with a speed (vn), which is smaller or equal to a conveying speed (vf) of the conveyor device.

10. A method according to claim 9, with the further steps:

moving the holding element in each case between two of the printed products, into a path which follows the revolving path of the lug belt, but lies next to this in a laterally displaced manner;

moving the holding element, following this path and with a speed (vu) which is smaller than the speed (vn) of the aligning lugs; and by way of this moving the edge region into the holding element.

11. A device for opening and the further-transport of printed products, with a conveyor device with transport clips which are driven in the conveying direction (F), are arranged at a distance behind one another and are designed to hold the printed products at their back running transversely to the conveying direction (F) and connecting first and second product parts to one another, with a support element which is arranged below the conveyor device and which forms a conveyor plane acting essentially in the conveying direction (F), for supporting the printed products at their edge region which lies opposite the back and which is bent to the front in the conveying direction (F), and with an opening element which revolves along a closed movement path and which is envisaged, above the support element, to move in between consecutive printed products and, running with the rear of these printed products, to bear from above onto its upper-lying product part and to firmly hold this, wherein the device comprises a holding element which is moved along a closed revolving path and which is envisaged, running with the respective printed product, to encompass the edge region of the printed product and to support it in the movement direction, wherein the opening element is envisaged to engage on the printed product in a holding region lying behind the edge region seen in the conveying direction, to firmly hold the second product part and to pull it out of the holding element.

12. A device according to claim 11, further comprising a lug belt driven in a revolving manner, from which aligning lugs project, which in the region of the upper section of the lug belt move with a speed (vn), which is smaller or equal to a conveying speed (vf) of the conveyor device and against which the printed products with their edge of the edge region, said edge lying opposite the back, are pushed for aligning.

13. A device according to claim 12, wherein the holding element is envisaged to move, in each case between two of the printed products, into a path which follows the revolving path of the lug belt, but lies next to this in a laterally displaced manner, and then to move following this path, with a speed (vu), which is smaller than the speed (vn) of the aligning lugs.

14. A device according to claim 11, wherein the opening element is a suction head, and preferably a vacuum, with which the suction head may be operated on opening the printed product, may be set with regard to its strength.

15. A device according to claim 11, wherein the holding element is formed of bent spring steel, for the loose or positive-fit and slightly frictional fit holding of printed products.

* * * * *